US005878812A

United States Patent [19]

Heinonen et al.

[11] Patent Number: 5,878,812

[45] Date of Patent: Mar. 9, 1999

[54] MISALIGNING WELLHEAD SYSTEM

[75] Inventors: Robert L. Heinonen; James A. Wilson, both of Dallas, Tex.

[73] Assignee: Double-E Inc., Dallas, Tex.

[21] Appl. No.: 855,297

[22] Filed: May 13, 1997

[51] Int. Cl.[6] ..... E21B 33/06; E21B 34/02

[52] U.S. Cl. ..... 166/85.4; 166/85.5; 166/86.1; 166/88.1; 166/95.1

[58] Field of Search ..... 166/84.1, 85.4, 166/85.5, 86.1, 88.1, 95.1, 97.1

[56] References Cited

U.S. PATENT DOCUMENTS

| | | | |
|---|---|---|---|
| 1,662,984 | 3/1928 | Scott et al. | 166/85.5 X |
| 2,069,443 | 2/1937 | Hill | 166/84.1 |
| 2,124,840 | 7/1938 | Wrigley | 166/84.1 |
| 4,286,791 | 9/1981 | McLean . | |
| 4,289,294 | 9/1981 | McLean . | |
| 4,415,026 | 11/1983 | Rezewski et al. | 166/97.1 |
| 4,688,632 | 8/1987 | Cooley, Jr. | 166/85.5 |
| 4,844,406 | 7/1989 | Wilson . | |
| 4,927,112 | 5/1990 | Wilson . | |
| 5,044,602 | 9/1991 | Heinonen . | |
| 5,141,052 | 8/1992 | Bump | 166/84.1 X |
| 5,211,227 | 5/1993 | Anderson | 166/84.1 |
| 5,246,067 | 9/1993 | Heinonen et al. | 166/81 |
| 5,257,812 | 11/1993 | Osorio et al. | 166/84.1 |
| 5,647,444 | 7/1997 | Williams | 166/84.1 X |
| 5,711,533 | 1/1998 | Angelo et al. | 166/84.1 X |

OTHER PUBLICATIONS

Double–E Inc.—Production Blowout Preventer LP–15 (undated).

Double–E Inc.—Flapper Valve (undated).

*Primary Examiner*—George Suchfield

*Attorney, Agent, or Firm*—Jenkens & Gilchrist P.C.

[57] ABSTRACT

A misaligning wellhead system for use on the surface end of well production tubing in a well produced by a pump driven by a pumping unit operated polished rod extending through the wellhead to the pump. The wellhead system includes a flange for connection of the system to the surface end of the production tubing, a blowout preventer above the flange, a flow tee above the blowout preventer for directing well fluids into a flowline, and a floating tubular body supporting a stuffing box and a flapper valve for torsional and lateral movement relative to the longitudinal axis through the wellhead body as the polished rod reciprocates to compensate for misalignment of the pumping unit relative to the wellbore centerline.

9 Claims, 2 Drawing Sheets

15
14
10
23
22
13
21
20
11
12

MISALIGNING WELLHEAD SYSTEM

This invention relates to well pumping apparatus and more particularly relates to wellhead systems used on wells produced by polished rod driven downhole pumps.

BACKGROUND OF THE INVENTION

Wells, particularly oil wells, extending into oil producing earth formations which do not have adequate pressure for flowing the wells may be produced by systems which include a downhole well pump operated by a polished rod supported from and driven by a pumping unit and extending through a wellhead at the surface to the downhole pump. The pumping unit may be any one of several type systems, such as, a pumping jack, a hydraulic prime mover which may reciprocate a polished rod or rotate the rod to drive a progressive cavity pump, and others. The wellhead may include a stuffing box to provide a pressure seal around the polished rod, a flapper valve for closing the bore through the wellhead in the event of breakage of the polished rod, and blowout preventers for sealing around the polished rod and used to close the bore through the wellhead in the absence of the polished rod. The various forces applied to a polished rod by the pumping unit and along the well bore between the pumping unit and the pump frequently effect both lateral and torsional or rotational movement to the polished rod which may cause excessive premature wear in the seals around the rod within the wellhead. The wellheads currently available for use on pumping wells are not equipped to compensate for/or accommodate misalignment of the polished rod as it. moves in the wellhead causing undue wear on the seals.

SUMMARY OF THE INVENTION

It is an object of the invention to provide a new and improved wellhead for use on a well having a pump operated by a surface powered polished rod.

It is a principal object of the invention to provide a wellhead including structure for accommodating rotational and lateral misalignment of a polished rod moving in the wellhead.

It is another object of the invention to provide a wellhead for a polished rod including secondary lower packing to enable the operator to change the upper packing without loss of pressure control.

It is another object of the invention to provide a wellhead of the character described which includes a flapper valve which will close if the polished rod breaks.

It is a further object of the invention to provide a wellhead to the character described which has blowout preventer rams which will close off the bore of the wellhead regardless of whether a polished rod string is present in or absent from the wellhead.

It is a still further object of the invention to provide a wellhead of the character described including blowout preventers which may act as a master valve.

In accordance with the invention, there is provide a misaligning wellhead system for a well having a pump operated by a polished rod which comprises a wellhead stack including blowout preventers and a floating tubular body around the polished rod supporting a flapper valve and a seal assembly. The floating structure permits the flapper valve and the seal assembly to move rotationaly and laterally to compensate for misalignment of the polished rod from the wellbore center line as the rod reciprocates to operate the well pump minimizing wear on the seals of the stuffing box.

BRIEF DESCRIPTION OF THE DRAWINGS

The foregoing objects and advantages and preferred embodiments of the invention will be understood from the following detailed description taken in conjunction with the accompanying drawings wherein.

DETAILED DESCRIPTION OF THE PREFERRED EMBODIMENT

Figure 1:
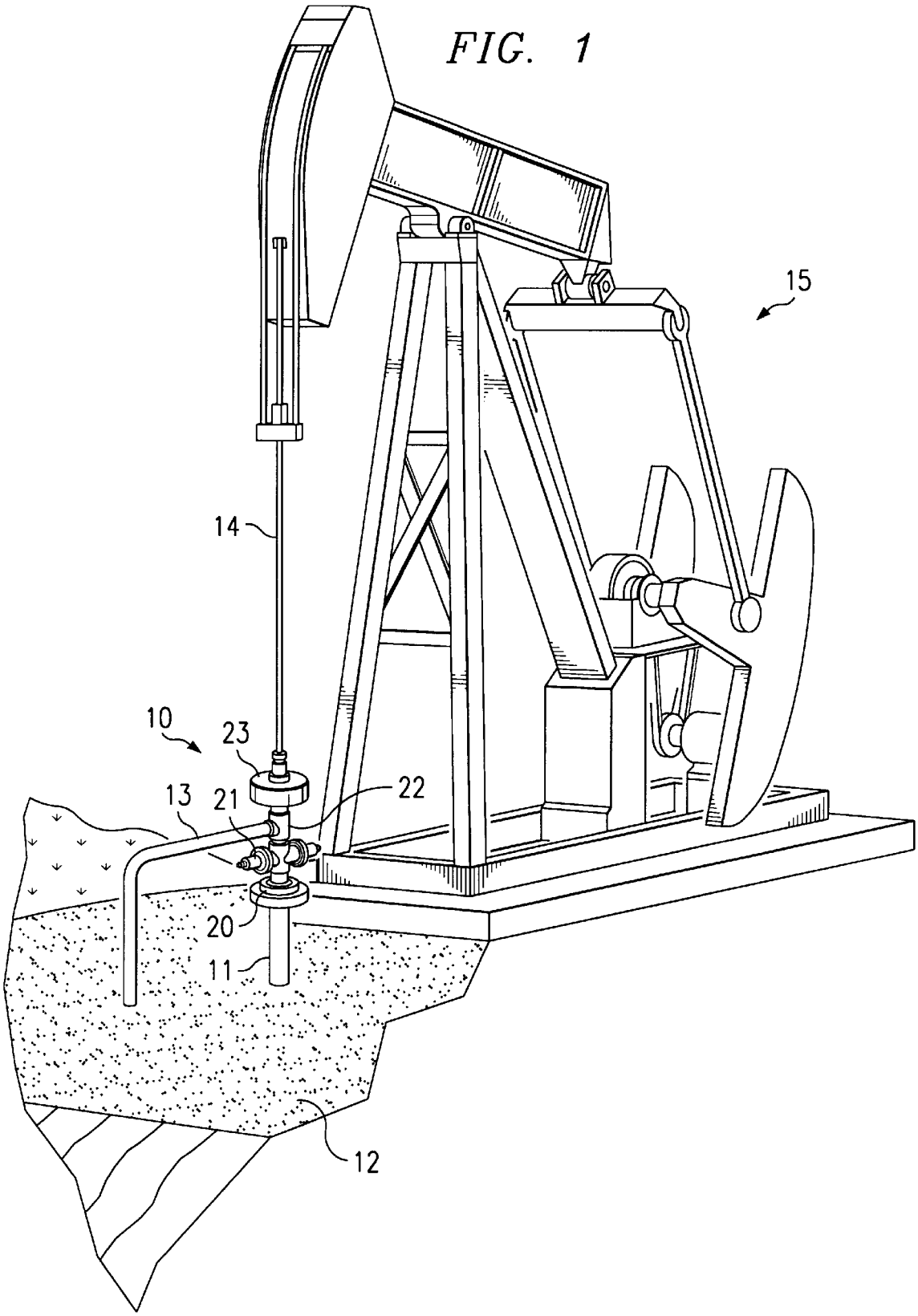
FIG. 1 is a schematic view in perspective of a well pumping unit operating a polished rod extending to a downhole well pump through a misaligning wellhead system in accordance with the invention.

Referring to FIG. 1, a misaligning wellhead system 10, in accordance with the invention, is mounted on the upper end of well tubing 11 extending to an oil producing formation 12 from which well fluids are produced through the wellhead into a flowline 13 connected into the wellhead. A polished rod 14 is connected to and operated by a pumping unit 15. The polished rod extends through the wellhead into the tubing to a pump, not shown, positioned along the tubing at the producing formation. The long slender polished rod 14 extends in the well tubing along sections which may deviate somewhat from the center line of the wellbore and may be subject to torsional and lateral misalignment compensated for by features of the misaligning wellhead system 10, in accordance with the invention. The pumping unit reciprocates or raises and lowers the polished rod 14 to operate the well pump.

Figure 2:
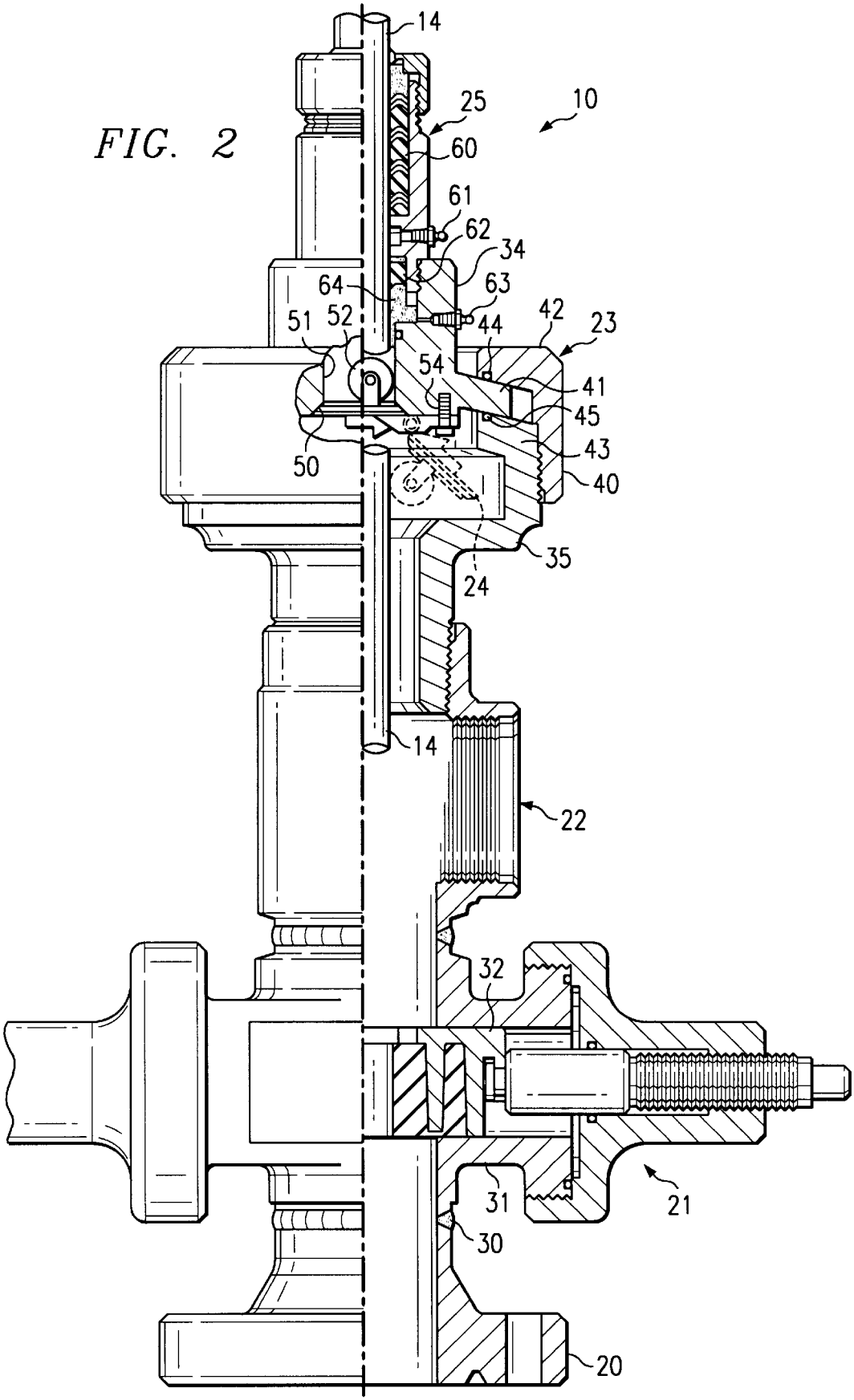
FIG. 2 is a longitudinal detailed view in elevation and section of a misaligning wellhead system in accordance with the invention.

Referring to FIG. 2, a misaligning wellhead system 10 embodying the invention includes a flange 20, a blowout preventer 21, a line pipe flow tee 22, a misaligning assembly 23 with a roller equipped flapper valve 24, and a stuffing box 25. In accordance with the invention, the misaligning assembly with the flapper valve and the dual packed stuffing box moves as a unit laterally and rotationally to adjust to misalignment of the pumping unit and polished rod relative to the wellbore center line.

Referring in more specific detail to FIG. 2, the flange 20 serves as a base for the wellhead 10 to mount the wellhead at the surface on a corresponding pipe flange on the upper end of the well tubing 11. The upper end of the flange 20 is connected at 30 to the body 31 of the blowout preventer 21. The blowout preventer 21, both structurally and functionally, is described in detail in U.S. Pat. No. 4,927,112, issued May 22, 1990, assigned to Double-E Inc. Dallas Tex., and is available from Double-E Inc. as Production Blowout Preventer LP-15. The blowout preventer has rams 32 which may seal on any diameter from 0 up to 1 ½". The rams are designed to close regardless of what polished rod string is in the well. The blowout preventer can act as a master valve since it can seal on zero. The pipe flow tee 22 is attached to the blowout preventer body 31. The flow tee functions to connect the wellhead 10 to the flowline 13 for directing well production fluids from the well to storage and other facilities, not shown.

Still referring to FIG. 2, the misaligning assembly 23 has a floating tubular body 34 supported for lateral movement between a base 35 and a cap 40 threaded on the upper end of the base. The base 35 has a lower end portion threaded into the upper end of the tee 22 and an enlarged upper externally threaded portion. The cap 40 is externally threaded on the upper base portion. The misaligning assembly floating body 34 has an external annular downwardly sloping flange 41 which is confined and moveable between an inwardly upwardly sloping flange 42 at the upper end of the cap 40 and an inwardly and upwardly sloping flange 43 on the upper end of the base 35. The lower face of the flange 42 is a concave spherical surface; the upper face of the flange 41 is a convex spherical surface; the lower face of the flange 41 is a concave spherical surface; and the upper face of the flange 43 is convex spherical surface so that the floating body flange 41 along with the body 34 may slide or rock laterally between the flanges 42 and 43 pivoting about the longitudinal centerline of the wellhead. Ring seals 44 and 45 seal the upper and lower faces of the flange 41 with the flanges 42 and 43 to prevent leakage out of or into the bore of the wellhead around the floating flange 41. This configuration of the flange 41 on the body 34 which serves as a base for the dual packed stuffing box 25 permits the rocking motion necessary to allow the stuffing box to accommodate to misalignment of the polished rod as it reciprocates for minimizing wear on the dual packing of the stuffing box.

As further illustrated in FIG. 2, the flapper valve 24 is shaped to engage a valve seat 50 on the lower end of the body 34 around the bore 51 through the body to seal the bore in the event that the polished rod breaks and falls downwardly from the bore. The flapper valve serves as a cutoff valve to prevent upward flow from the wellhead in the event of rod breakage. A roller 52 is mounted at the center of the lower face of the flapper valve 24, such lower face looking downwardly when the flapper valve is open as shown in phantom lines in FIG. 2. The flapper valve is spring loaded, biased toward the closed position and includes a mounting 53 connected by a screw 54 threaded into the lower end face of the body 34. The flapper valve 24 including the roller 52 is a standard available assembly from Double-E Inc., Dallas, Tex., designated as Type R Flapper Valve. The roller on the flapper valve freely rolls along the surface of the polished rod as it reciprocates during normal operation protecting the polish rod and the flapper valve from wear.

The stuffing box 25 illustrated in FIG. 2 includes upper packing 60, a lubricant fitting 61, a lower packing 62, a lower lubricant fitting 63 and a brass piston 64. Fitting 63 permits fluid or grease to be injected for the purpose of pressurizing the brass piston below lower packing 62. This pressure causes the piston to move upwardly, forcing packing 62 into sealing engagement with the polished rod. Engaging the lower packing permits the upper packing to be changed without the loss of pressure control.

During the pumping of a well the polished rod 14 suspended from the pumping unit 15 extends through the wellhead 10 as illustrated in FIGS. 1 and 2, downwardly to the well pump, not shown. The blowout preventer 21 rams are retracted to permit the polished rod to pass through the blowout preventer. The flapper valve 24 is in the open position shown in phantom lines in FIG. 2 with the roller 52 engaging the outer surface of the polished rod so that the polished rod may reciprocate without damage to the rod and the flapper valve. As the polished rod moves upwardly and downwardly, any misalignment of the polished rod causes the misaligning assembly 23 to pivot or rock allowing the upper and lower packing to move with the assembly thereby minimizing the wear of the packing. If the polished rod breaks and drops downwardly in the wellhead below the flapper valve 24, the flapper valve will close shutting off flow through the wellhead. The rams of the blowout preventer may be closed around the polished rod, or, if a broken polished rod falls below the rams, the rams be closed together to fully shut off the flow through the wellhead below the flow tee 22, the blowout preventer acting as a master valve.

The use of the unitized blowout preventer 21, with the flow tee 22, and the flange 20 minimizes the overall height of the wellhead system 10. This eliminates having to limit the pumping unit stroke. It has been found that the overall height of an entire wellhead can be limited to only 36 inches.

What is claimed is:

1. A misaligning wellhead system for use on a well produced by a pump driven by a polished rod comprising:

a wellhead body including means for connecting the body to the surface end of production tubing in the well;

a misaligning assembly connected with the wellhead body having a bore for the polished rod and moveable to conform to lateral and rotational misalignment of the polished rod in the wellhead, the misaligning assembly including a first outer annular body portion secured with the wellhead body and a floating internal annular body portion including the bore for the polished rod, the internal body portion having an external annular support flange, the outer annular body portion having a internal annular recess for the support flange on the inner annular body portion, and seal means between the support flange and the outer annular body portion in the recess in the outer annular body portion; and a stuffing box secured with the floating internal annular body portion around the bore for sealing and lateral and rotational movement with the polished rod passing through the assembly into the production tubing.

2. A system in accordance with claim 1 wherein the external annular support flange on the inner body portion and the internal recess in the outer annular body portion have concave shapes facing the means for connecting the wellhead body to the production tubing and which are circular arcs in cross section to permit movement of the inner body portion about an axis point along the longitudinal center line of the wellhead body toward the means for connecting the wellhead body to the production tubing to compensate for misalignment of the polished rod as the polished rod moves in the wellhead system.

3. A system in accordance with claim 2 including a flapper valve secured with the inner body portion of the misaligning assembly toward the means for connecting the wellhead body to the production tubing to close the bore through the misaligning assembly in the event of removal of the polished rod from the bore through the misaligning assembly.

4. A system in accordance with claim 3 including a roller on the flapper valve engageable with the polished rod to prevent contact between the flapper valve and the polished rod.

5. A system in accordance with claim 4 where the seal means in the floating internal annular body portion of the misaligning assembly comprises an inner seal assembly and an outer seal assembly, the outer seal assembly being replaceable while a well is under pressure.

6. A well system in accordance with claim 5 including a flow tee in the wellhead body between the misaligning assembly and the means for connecting the wellhead body to the production tubing.

7. A well system in accordance with claim 6 including a blowout preventer in the wellhead body between the flow tee and the means for connecting the wellhead body to the production tubing.

8. A misaligning wellhead system for use on a well produced by a pump driven by a polished rod operated by a pumping unit comprising:

a base flange for connection of the wellhead system with the surface end of a production tubing string in the well;

a blowout preventer connected with the flange adapted to shut off flow through the wellhead system with or without a polished rod extending through the wellhead system;

a flow tee connected with the blowout preventer to direct production fluids from the well into a flowline connected into the flow tee;

a misaligning assembly connected with the flow tee including an outer body portion having a base portion and a cap portion defining therebetween an annular recess, and a floating inner body portion having an external annular flange slidable in the recess in the outer body portion whereby the floating inner body portion may move laterally and rotationally relative to the outer body portion, and seal means between the annular flange and the outer body portion in the recess for sealing between the flange and the outer body portion;

a flapper valve mounted on the floating inner body portion moveable between an open position when a polished rod is present through the wellhead system and a closed position when the polished rod is absent from the wellhead system, a roller being mounted on the flapper valve to engage a polished rod moving in the wellhead system to shield the flapper valve from the polished rod as the polished rod moves; and a stuffing box mounted on the internal floating body portion of the misaligning assembly for sealing around a polished rod moving in the wellhead system.

9. A misaligning wellhead system in accordance with claim 8 where the flange on the floating inner body portion of the misaligning assembly and the recess in the outer body portion of the misaligning assembly are spherical concave shapes facing the base flange whereby the inner body portion of the misaligning assembly moves relative to a point in the longitudinal axis of the wellhead system toward the base flange as the misaligning assembly moves laterally and rotationally to adjust to misalignment of the pumping unit and polished rod as the polished moves in the wellhead system.

* * * * *